US010897676B2

(12) United States Patent
Wagner et al.

(10) Patent No.: US 10,897,676 B2
(45) Date of Patent: Jan. 19, 2021

(54) CUSTOMIZED DEVICE FOR INSERTION OF A DEEP-CANA HEARING AID AND A METHOD FOR MANUFACTURING AND USING SUCH AN INSERTION DEVICE

(71) Applicant: Sonova AG, Staefa (CH)

(72) Inventors: Paul Wagner, Meilen (CH); Michael Au, Union City, CA (US); Barjinder Chana, San Jose, CA (US); Karamuk Erdal, Männedorf (CH); Mehnaz Khan, Sunnydale, CA (US); Daniel Baer, Zürich (CH); Gerald van Oerle, Uster (CH); Andi Vonlanthen, Oberrohrdorf (CH)

(73) Assignee: Sonova AG, Staefa (CH)

( * ) Notice: Subject to any disclaimer, the term of this patent is extended or adjusted under 35 U.S.C. 154(b) by 220 days.

(21) Appl. No.: 16/310,044

(22) PCT Filed: Jun. 17, 2016

(86) PCT No.: PCT/US2016/038179
§ 371 (c)(1),
(2) Date: Dec. 14, 2018

(87) PCT Pub. No.: WO2017/218012
PCT Pub. Date: Dec. 21, 2017

(65) Prior Publication Data

US 2019/0230453 A1 Jul. 25, 2019

(51) Int. Cl.
*H04R 25/00* (2006.01)
*H04R 25/02* (2006.01)

(52) U.S. Cl.
CPC ..... *H04R 25/60* (2013.01); *H04R 25/00* (2013.01); *H04R 25/652* (2013.01); *H04R 25/02* (2013.01);

(Continued)

(58) Field of Classification Search
CPC ..... H04R 25/00; H04R 25/02; H04R 25/60; H04R 25/652; H04R 2225/023; H04R 2460/17
See application file for complete search history.

(56) References Cited

U.S. PATENT DOCUMENTS 4,756,312 A * 7/1988 Epley ..... H04R 25/606 381/312
8,155,361 B2 * 4/2012 Schindler ..... H04R 25/00 381/329

(Continued)

FOREIGN PATENT DOCUMENTS

EP 2922312 A1 9/2015

OTHER PUBLICATIONS

International Search Report and Written Opinion; Application Nr. PCT/US2016/038179 filed on Jun. 17. 2016; dated Feb. 16, 2017; 11 pages.

*Primary Examiner* — Matthew A Eason

(57) ABSTRACT

This invention relates to a device for insertion of a deep-in-the-canal hearing aid—alternatively designatable as extended wear hearing aid—into an ear canal of an individual user, at a pre-determined insertion depth (d) thereof. The insertion device comprises a customized support comprising an outer profile conforming to the shapes of at least a portion of a conchal cavity and of an ear canal of said individual user; and a guide channel, disposed internal to said outer profile, extending between a lateral entry opening thereof, for loading said hearing aid; and a medial exit opening thereof, for releasing said hearing aid into said ear canal. The present invention also relates to a method of manufacturing an insertion device for inserting a hearing aid deep into an ear canal of an individual hearing aid user, at a pre-determined insertion depth (d) thereof.

20 Claims, 9 Drawing Sheets

(52) U.S. Cl.
CPC .... *H04R 2225/023* (2013.01); *H04R 2460/17* (2013.01)

(56) References Cited

U.S. PATENT DOCUMENTS

| | | | | |
|---|---|---|---|---|
| 8,184,842 | B2 * | 5/2012 | Howard | H04R 25/60 381/329 |
| 8,411,889 | B2 | 4/2013 | Naumann et al. | |
| 9,936,314 | B2 * | 4/2018 | Rasmussen | H04R 25/652 |
| 2008/0144871 | A1 * | 6/2008 | Purcell | A61F 11/10 381/329 |
| 2011/0188692 | A1 * | 8/2011 | Naumann | H04R 25/00 381/329 |
| 2013/0223666 | A1 * | 8/2013 | Michel | H04R 25/00 381/329 |

* cited by examiner

CUSTOMIZED DEVICE FOR INSERTION OF A DEEP-CANA HEARING AID AND A METHOD FOR MANUFACTURING AND USING SUCH AN INSERTION DEVICE

The present invention relates to a device for insertion of a hearing aid into an ear canal of an individual user at a pre-determined insertion depth thereof.

More particularly, the present invention relates to a device for insertion of deep-in-the-canal hearing aids, that is of hearing aids invisible in the canal that are meant to be worn in the bony region of the ear canal, preferably entirely therein retained, for extended periods, without daily insertion and removal.

Such hearing aids are also generally designated as extended wear hearing aids.

Referring to more specific use cases, the present invention relates to a device designed to allow self-insertion of extended wear hearing aids by the same individual that will be using the hearing aids in an own ear canal; as well as insertion by other operators—not necessarily having the expertise of audiologists—such as caregivers or significant others of such individual user, for instance in a domestic environment.

The present invention also relates to a method of manufacturing an insertion device for inserting, by an operator or by an individual user, a hearing aid deep into an ear canal, at a pre-determined insertion depth thereof.

In the context of the present invention, the term hearing aid shall be understood as a device to be worn directly within the ear of a person to improve the individual hearing capacity of this person. Such an improvement may include preventing reception of certain acoustic signals in terms of ear protection.

Hearing aids normally comprise at least one microphone as electroacoustic input transducer; and at least one speaker—usually called receiver—as electroacoustic output transducer. Generally, hearing aids also comprise an electronic signal processing circuitry, connected with said microphone and said speaker, for the processing and manipulation of electronic signals. This electronic signal processing circuitry may comprise analogue or digital signal processing devices for performing various signal processing functions which may include amplification, background noise reduction, tone control, etc.

As said, extended wear hearing aids are configured to be worn continuously, from several weeks to several months, inside the ear canal, preferably within a reduced, predetermined distance of the tympanic membrane for optimal functioning. Such devices may be miniature in size in order to fit entirely within the ear canal and are configured such that the speaker, or receiver, fits deeply in the ear canal in proximity to the tympanic membrane of the individual user. Typically, extended wear hearing aids comprise specialized acoustic seals which are configured to suppress sound transmission and feedback and designed to suspend the device comfortably in the limited space offered by the deep ear canal, while maintaining healthy conditions of such ear canal. In the section dedicated to a detailed description of embodiments of the present invention, extended wear hearing aids, to be inserted by devices according to the present invention, will be further introduced in relation to the ear canal characteristics.

Current re-fitting processes of extended wear hearing aids require that patients—otherwise designatable as hearing aid users—visit at least their hearing aid providers. Any adjustment of extended wear hearing aids which implies extraction thereof from an ear canal (including battery replacement) cannot be effectively dealt with by the hearing aid user directly or by unskilled caregivers. According to current practice, only hearing aid providers and skilled operators—such as audiologists, clinicians or similar health care professionals—have the means to evaluate ear health and are qualified to service, refit and program extended wear hearing aids.

The problem of (re-)insertion of extended wear hearing aids arises on occasions when patients may otherwise have to remain without hearing aids for extended periods of time. The unavailability of hearing aids would negatively impact the user experience of a hearing solution which has been originally conceived as a 24/7 hearing solution.

It is recommended in certain circumstances that extended wear aids be removed because their use is not compatible with safety or a correct functioning. For instance, patients that need to go through certain medical procedures, such as MRI, are required to remove their extended wear hearing aids prior to carrying out the examination. Patients that perform certain physical activities, such as swimming or diving, are also recommended to remove their extended wear hearing aids prior to starting their sport session.

For certain elderly or disabled patients visiting their extended wear hearing aid providers for servicing may prove a difficult task, due to physical restrictions and/or to distance and/or accessibility to the provider's office. Patients that travel to locations or countries where there are no extended wear hearing aid providers may not be able to get refitted with a new device, should their devices become non-functional. At any rate, even if one such provider was given at their travel location, it proves often difficult to schedule a refit in a timely manner. In addition, many providers charge a fee for servicing outside patients who are not regular clients.

In light of the above issues encountered when re-fitting according to current practices, tools and procedures effectively enabling self-insertion, or insertion by non-professional operators, of extended wear hearing aids would help reduce trial cancellations, and would let existing customers overcome various difficult situations, while improving overall user experience.

In addition to that, self-insertion may reduce the overall workload of hearing aid providers, as fewer visits would be required per subscription.

Current technology does not allow a controlled, targeted, safe and reliable insertion of extended wear hearing aids in an ear canal. Some patients try to anyhow perform self-insertion of extended wear hearing aids by their own fingers or employing some tool at present available, oftentimes unspecific for this application. This is suboptimal and they would however need at least visual guidance in handling such tools to avoid a risk of injuring themselves.

U.S. Pat. No. 8,155,361 B2 discloses a device for insertion of a hearing aid deep into an ear canal which, to a certain extent, may support insertion by an operator other than an expert health care professional. Such device comprises a capsule, formed by a cover portion and a base portion, wherein the base portion comprises a chimney configured to accommodate and permit passage of a hearing aid. However, the tool therein presented is not perfected in a way that precise placement of the hearing aid in an intended location relative to the ear canal can be attained, at a depth which maximizes the performance of the hearing aid. In fact, from FIGS. 5 and 6 it is easy to recognize how the pressure applied by an operator to a piston designed to displace the hearing aid results in the overall deformation of the tool's components (base portion; chimney; chimney channel and piston itself). Such an arrangement cannot guarantee that, following the tool's manipulation, the hearing aid will be actually delivered exactly to an intended region of the ear canal, at an insertion depth optimal for obtaining the best hearing aid performances.

Moreover, in the case of the insertion tool of U.S. Pat. No. 8,155,361 B2, the deformability of the protruding piston and of the structure supporting it, as well as the design concept of cover, base and chimney according to a "a common one-size-fitting all sizes or most sizes" principle, cannot completely prevent the risk of impacting the walls of the ear canal, in operation. This can be easily derived from the two configurations shown in FIGS. 5 and 6 of U.S. Pat. No. 8,155,361 B2

Thus, there exists a need for a device for insertion of a deep-in-the-canal hearing aid into an ear canal of an individual user which is designed so that:

- insertion of such a hearing aid is carried out in a way that the actual situation within the ear canal is taken into account, allowing placement of the hearing aid in an intended location relative to the ear canal, at a pre-determined insertion depth thereof suitable for the best functioning of the hearing aid;
- safety is guaranteed, even when manipulation of the insertion device in the ear canal is carried out by operators or clinicians with limited experience or by the patient himself for self-insertion of the hearing aid in his own ear canal.

There also exists a need for a related method of manufacturing an insertion device designed to achieve the above-mentioned objectives.

Accordingly, a major objective of the present invention is to provide a new ameliorated design for an insertion device that supports a guided, efficient and accurate placement of an extended wear hearing aid in an intended location within an ear canal at a pre-determined insertion depth thereof; as well as to provide a correlated method of manufacturing such an insertion device.

Another objective of the present invention is to improve the ability of an operator—even one who is not a skilled health professional i.e. not necessarily an audiologist, a clinician or an assistant—to insert an extended wear hearing aid, or similar, in ear canal in a predictable, controlled way. Thus, in order to execute a correct hearing aid placement by using the present invention, there is virtually no need to navigate the insertion through the bodily structures of an ear canal and empirically monitor position and orientation through the insertion process. Thanks to the present insertion device, even the hearing aid user or patient himself can achieve to reach an intended location in the ear canal without assistance by third parties.

Yet other objectives of the present invention are to drastically reduce the risk of injuries, abrasions or hematoma to ear canals when fitting extended wear hearing aids; to improve the success rate in trials to fit such hearing aids; to improve subscription renewal rates to extended wear hearing aid programs; to improve extended wear hearing aid usage convenience; to reduce and rationalise the workload of professional operators such as fitters, eliminating for instance disruptive unscheduled refit procedures.

These problems are solved through an insertion device, and a correlated method of manufacturing such an insertion device, according to the main claims. Dependent claims further introduce particularly advantageous embodiments for such a device and related method.

The inventive solution basically requires to design an insertion device comprising a customized support with a guide channel and with a drive mechanism for moving a hearing aid, through the guide channel, up to a predetermined insertion depth, wherein the customized support comprises an outer profile which is individually shaped to replicate the shapes of at least a portion of a conchal cavity and of an ear canal of an individual hearing aid user. The outer profile is also preferably resistant to deformation.

The design of the insertion device according to the present invention advantageously enables a reliable placement of an extended wear hearing aid within an ear canal which is guided and controlled throughout the insertion process, in that the insertion is compliant with the anatomy of the ear canal.

The design of the insertion device according to the present invention also allows, at least to a certain extent, a decoupling of the insertion forces applied by an operator on a drive mechanism of the insertion device from the ensuing advancement of the extended wear hearing aid in the ear canal, such that excess forces do not result in an uncontrolled progression of the hearing aid towards a user's tympanic membrane.

In addition to that, the insertion device according to the present invention is especially conceived to pre-arrange the hearing aid, already during the insertion procedure, to suit the lodging region of the ear canal where the hearing aid is meant to be eventually placed. In fact the hearing aid is not only accurately positioned at the correct insertion depth of the ear canal but, preferably, also oriented based on the orientation of the ear canal itself in the lodging region.

Other objectives, features and advantages of the present invention will be now described in greater detail with reference to specific embodiments represented in the attached drawings, wherein.

Figure 17:
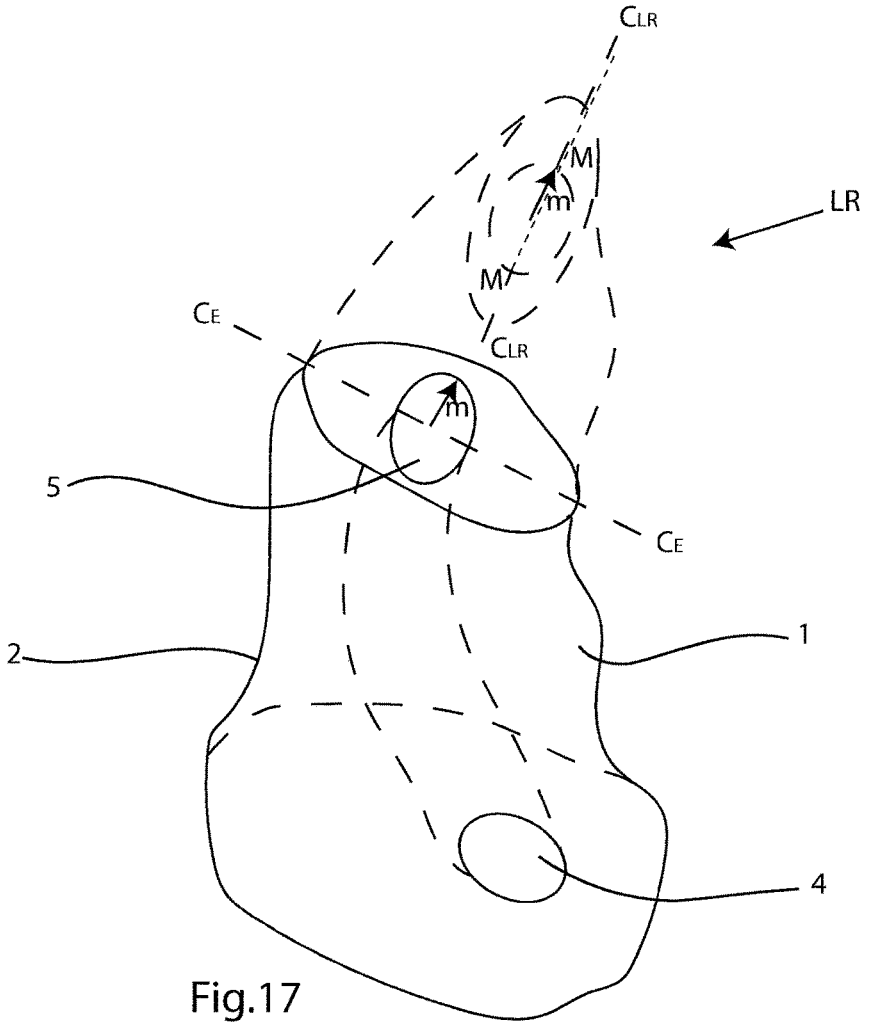
Figure 18:
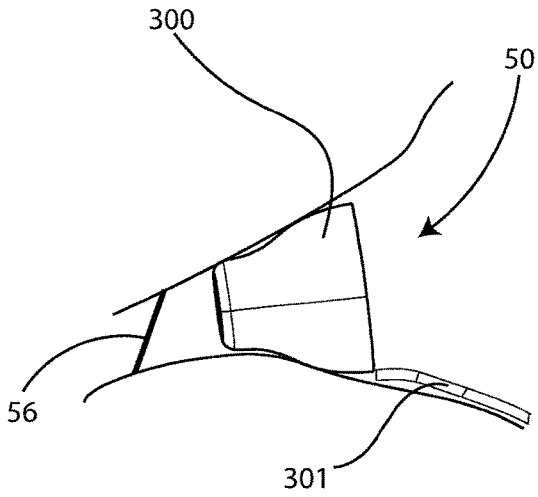
Figure 18A:
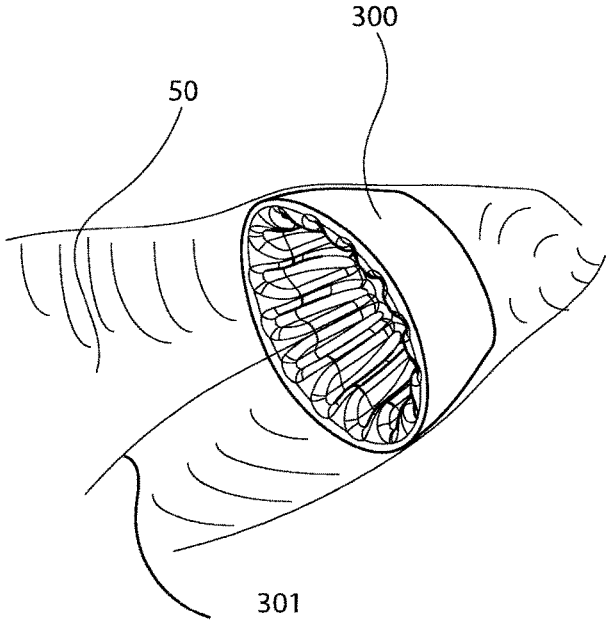
Figure 19:
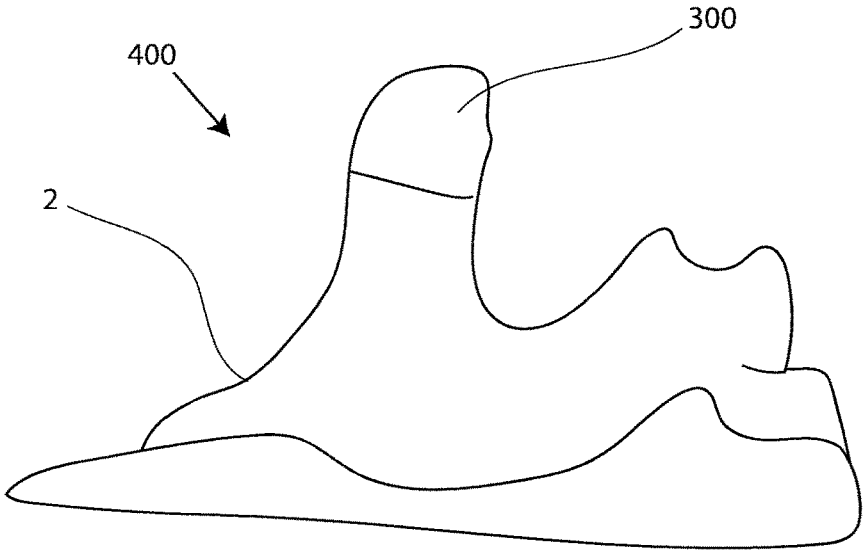
Figure 20:
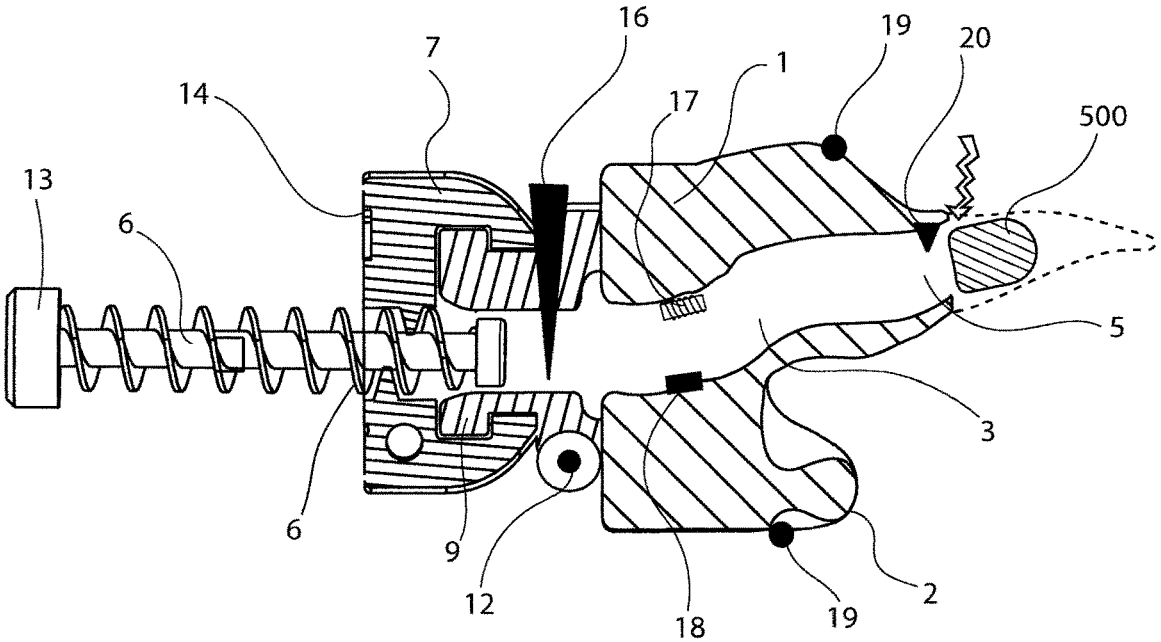

FIG. 17 is a schematic perspective view of a third customized support of an insertion device according to the present invention, showing in transparency an inner guide channel and exemplifying how such guide channel at a medial exit opening is oriented based on an orientation of a lodging region of the ear canal of an individual user, located beyond the medial exit opening, intended to accommodate an extended wear hearing aid;

FIG. 18 is a schematic view illustrating, in a simplified way, an impression-taking pad inside an ear canal;

FIG. 18A is a further view of the impression-taking pad of FIG. 18, showing an inner surface of the body of the impression-taking pad which is provided with scallop-like protrusions;

FIG. 19 is a schematic representation of an impression of an ear canal obtained by the impression-taking pad of FIG. 18; and FIG. 20 is a schematic, partially in section side view of one further embodiment of the insertion device according to the present invention, exemplifying the case wherein such insertion device comprises a magnetically actuatable control means and/or an optical control means and/or a radio frequency control means; an electroacoustic detection means; a humidity sensor means and/or optical measurement means; and presence and/or proximity sensor means and/or visual detection means cooperating with a locking means for locking the insertion device drive mechanism.

Figure 1:
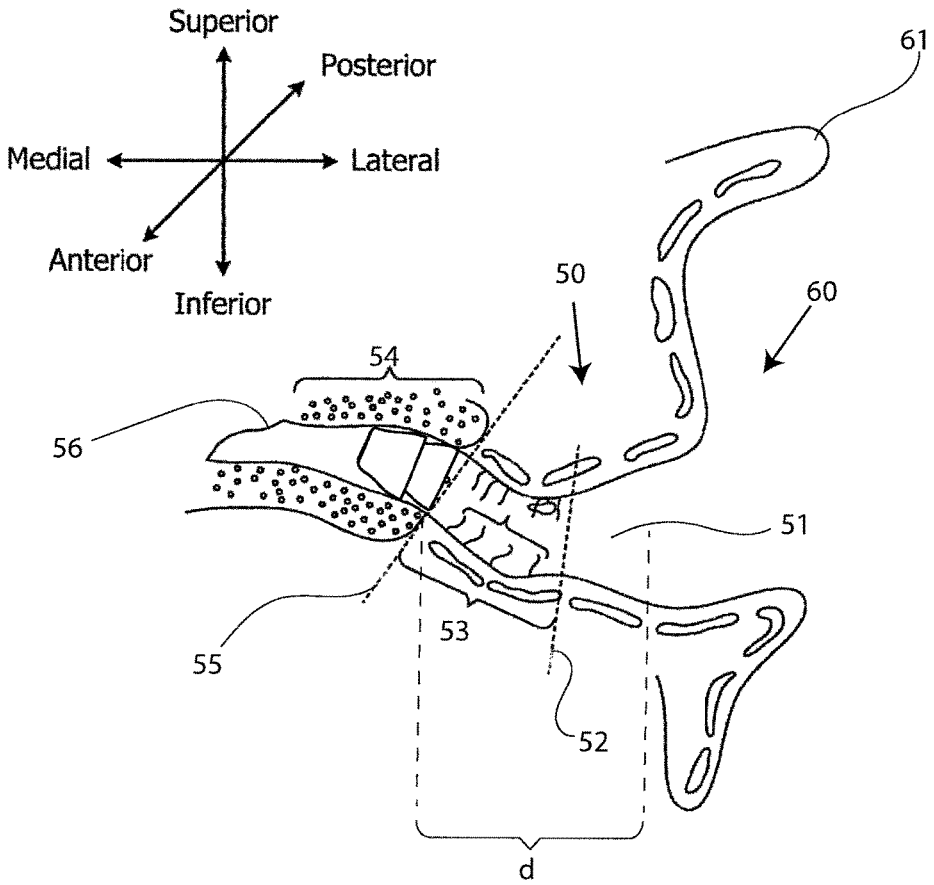
FIG. 1 is a cross-sectional view showing the anatomical features of an ear and of a related ear canal wherein an extended wear hearing aid has been inserted.
Figure 2:
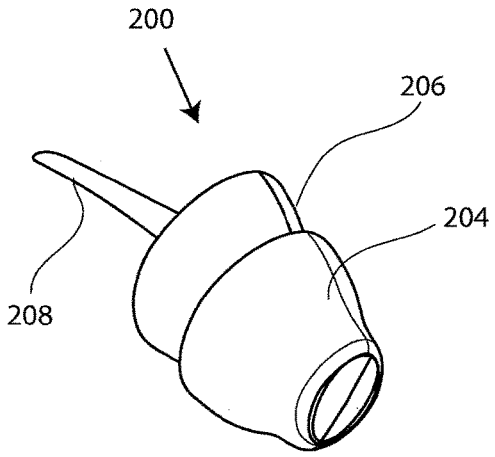
FIG. 2 is a perspective side view of the extended wear hearing aid of FIG. 1, apt to show a medial portion thereof.
Figure 3:
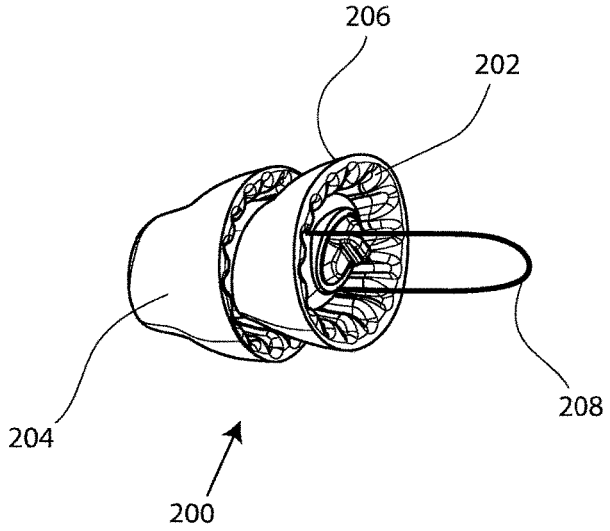
FIG. 3 is a perspective side view of the extended wear hearing aid of FIG. 1, apt to show an inner lateral portion thereof.

With reference initially to FIG. 1, wherein a cross-sectional view of an ear canal is displayed (the cross-section being taken according to a coronal plane i.e. a plane dividing a human body into ventral and dorsal sections), an adult's ear canal 50 extends from an ear canal aperture 51 to a tympanic membrane (or "eardrum") 56. Such ear canal 50 includes a lateral cartilaginous region 53 and a medial bony region 54.

In this context, "lateral" will mean oriented or disposed away from the tympanic membrane 56; whereas "medial" will mean oriented or disposed towards the tympanic membrane 56, as also portrayed by way of arrows in FIG. 1.

An adult ear canal 50 axially measures, approximately, 25 mm in length from the canal aperture 51 to the tympanic membrane 56. The cartilaginous region 53 is relatively soft due to the underlying cartilaginous tissue, and deforms and moves in response to the mandibular or jaw motions, which occur during talking, yawning, eating, etc. The bony region 54 (also designatable as "bony canal") is instead rigid, roughly 15 mm long and represents approximately 60% of the canal length. At any rate, canal shape and dimensions can vary significantly among individuals. The skin in the bony region 54 is thin relative to the skin in the cartilaginous region and is typically more sensitive to touch or pressure. There is a characteristic bend which occurs approximately at a junction 55 between cartilaginous region 53 and bony region 54; such bend is commonly referred to as the second bend of the ear.

The ear canal 50 terminates medially with the tympanic membrane 56.

Lateral of, and external to, the ear canal 50 are a concha cavity 60 and a cartilaginous auricle 61. The junction between the concha cavity 61 and cartilaginous region 53 of the ear canal 50 at the aperture 51 is also defined by a characteristic bend 52, which is known as the first bend of the ear canal.

As said, extended wear hearing devices are configured to be worn continuously, from several weeks to several months, inside the ear canal. Some extended wear hearing devices are configured to rest entirely within the bony region 54 and, in some instances, within 4 mm of the tympanic membrane 56. Examples of extended wear hearing devices are disclosed in U.S. Patent Pub. No. 2009/0074220, U.S. Pat. Nos. 7,664,282 and 8,682,016, each of which is incorporated herein by reference.

Referring to Figures from 2 to 4, an exemplary extended wear hearing device 200 comprises a core 202; a medial and a lateral seal retainer (or "seals") 204 and 206, and a removal loop 208. Typically, a contamination guard with a screen (not shown) abuts a microphone. The core 202 usually includes a housing as well as a battery, a microphone, a receiver, and control circuity located within the housing. The seals 204 and 206 suspend and retain the hearing device core 202 within the ear canal 50 and also suppress sound transmission and feedback which can occur when there is acoustic leakage between the receiver and microphone.

Figure 4:
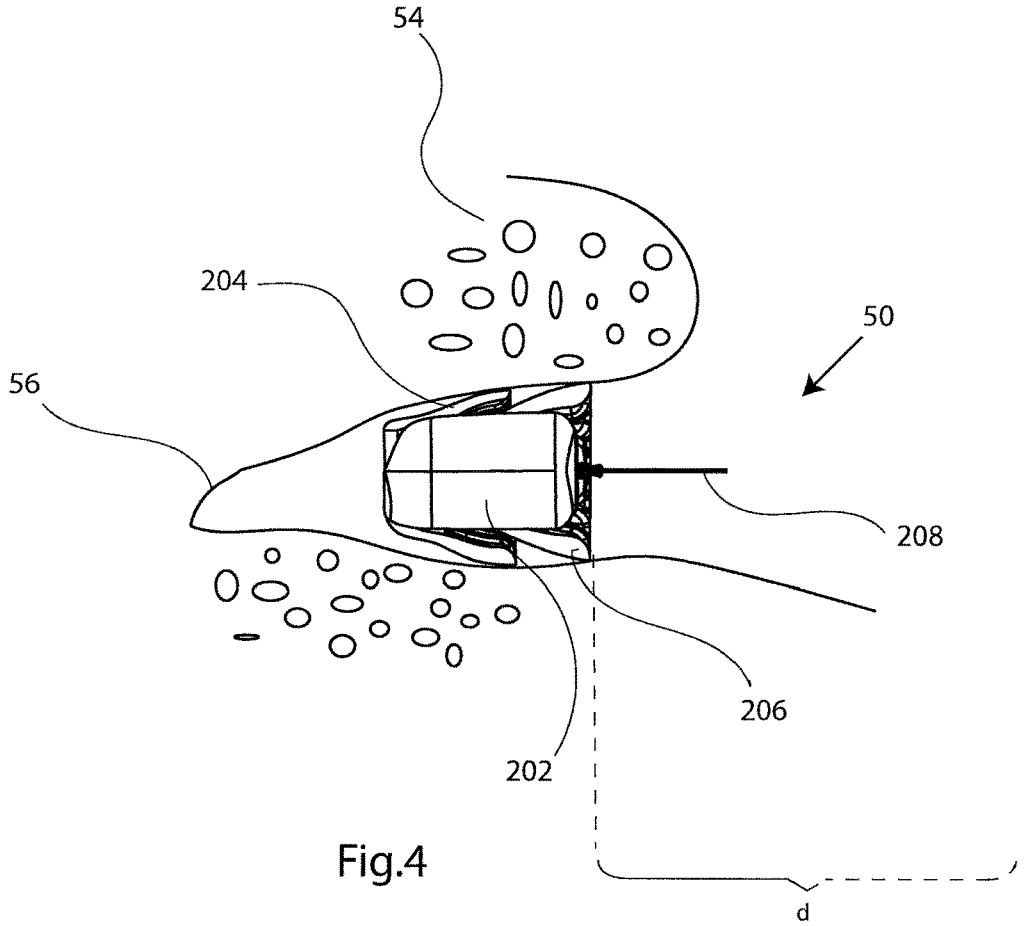
FIG. 4 is a zoomed-in section view focusing on the bony portion of the ear canal where the extended wear hearing aid of FIGS. 1, 2 and 3 is placed.

The seals 204 and 206 are frequently formed from a highly porous and highly compliant foam material (e.g., hydrophilic polyurethane foam), which conforms to the ear canal geometry by deflection and compression, as it is illustrated in FIG. 4.

It is especially important that the seals be properly sized for the intended ear canal and that the interface between ear canal 50 and seals 204, 206 be even, without irregularities such as gaps or folds, in order to prevent discomfort and inadequate feedback suppression.

Attaining, upon insertion, an optimal insertion depth d (as measured, for instance, from the canal aperture 51) of a hearing aid 200 inside the ear canal 50 is of paramount importance in order to prevent any discomfort in use of the hearing aid, as well as any injury during and at completion of the insertion procedure; and in order to maximize the beneficial effects of the hearing aid on the sound and noise perception of a hearing aid user.

Figure 5:
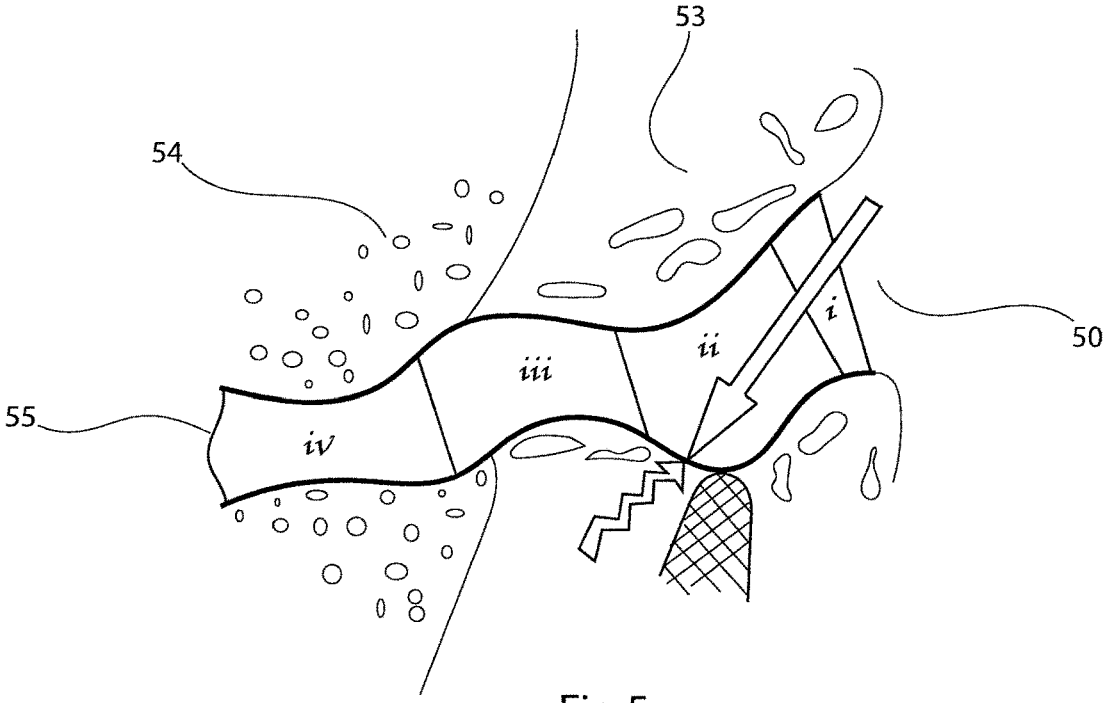
FIG. 5 is a schematic, section representation of an ear canal, exemplifying one of the risky situations potentially encountered when inserting an extended wear hearing aid with an unsuitable insertion device according to the prior art.

Also, it is important to prevent situations as shown in FIG. 5, wherein an insertion of a hearing aid is not properly assisted and guided and the anatomy of the ear canal is not effectively taken into account. In the case exemplified, a procedure which employs an unsuitable insertion tool might cause an undesired impact with the walls of the ear canal 50.

Figure 6:
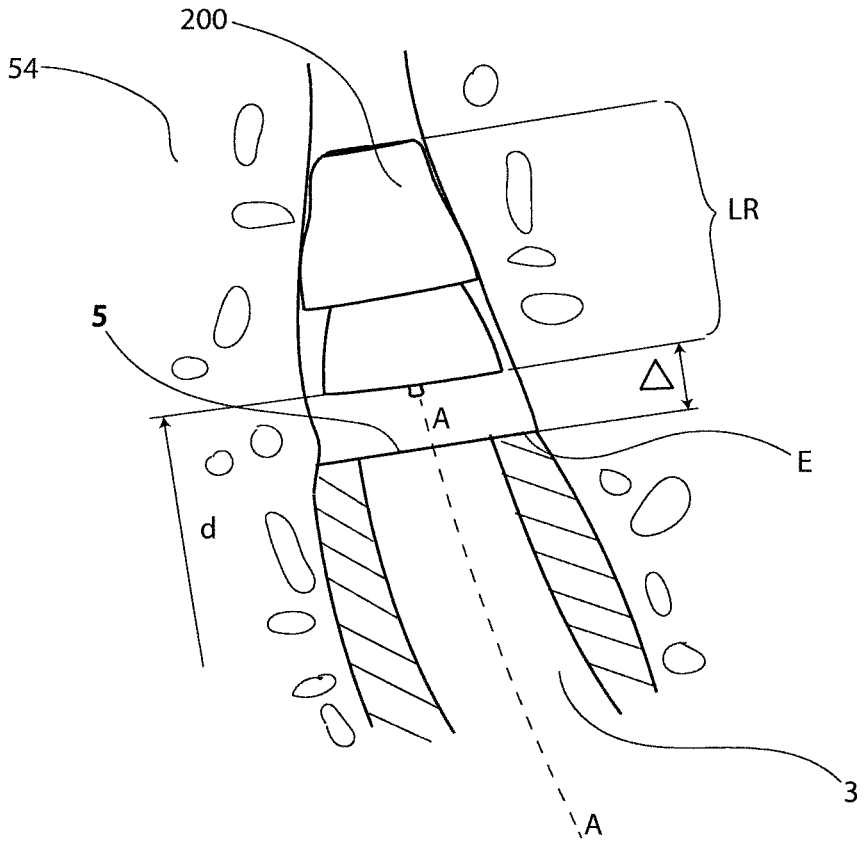
FIG. 6 is a schematic representation of a placement of an extended wear hearing aid in a lodging region of an ear canal, achieved at a pre-determined insertion depth thereof thanks to the use of an insertion device according to the present invention.

FIG. 6 exemplifies a placement of an extended wear hearing aid 200 in a lodging region LR of an ear canal, preferably a portion of the bony region 54, achieved at a pre-determined insertion depth d of the ear canal, thanks to the use of an insertion device according to the present invention. In the example of the illustration, a placement of the hearing aid 200 in the ear canal at an estimated, optimal insertion depth d is finalized by letting a drive mechanism of the insertion device according to the present invention release the hearing aid 200 at a distance Δ extending from a medial exit opening 5 of the insertion device 100.

In the present invention, an insertion device 100 for insertion of a deep-in-the-canal hearing aid 200 into the ear canal 50 of an individual user at a pre-determined insertion depth d comprises a customized support 1 and a drive mechanism. The drive mechanism is preferably actuatable by the individual user himself, in case of self-insertion in an own ear canal, or by a distinct insertion device operator. By the wording "individual user" in the following, the individual hearing aid user will be generally meant.

With reference to FIG. 6 and more specifically to FIGS. 7-9 and FIGS. 10-12, respectively portraying two embodiments for an insertion device 100 according the present invention, the customized support 1 comprises an outer profile 2 conforming to the shapes of at least a portion of a conchal cavity 60 and of an ear canal 50 of an individual user. The customized support 1 also comprises a guide channel 3, disposed internal to the outer profile 2, extending between a lateral entry opening 4 thereof, for loading said hearing aid 200; and a medial exit opening 5 thereof, for releasing the hearing aid 200 into the ear canal 50.

The drive mechanism is configured to move the hearing aid 200 through the guide channel 3, from the lateral entry opening 4, through the medial exit opening 5, up to a pre-determined insertion depth d.

The outer profile 2 is individually shaped to replicate the shapes of at least a portion of the conchal cavity 60 and of the ear canal 50 of the individual user. The outer profile 2 is also resistant to deformation.

In fact, the outer profile 2 is preferably substantially undeformable, in that it does not give way under an applied pressure to the extent of changing its shape.

In a preferred embodiment, the outer profile 2 is rigid. Thus, preferably, from the phase when the customized support 1 is snugly fitted to the conchal cavity 60 and to the ear canal 50; to the phase when the hearing aid 100 is let out through a medial exit opening 5 and deployed in the ear canal, the outer profile 2 keeps its shape originally conforming to the anatomy of the concha and of the ear canal.

Therefore, preferably throughout the guided passage of the hearing aid 200 from the lateral entry opening 4 to the medial entry opening 5, during activation of the drive mechanism, the outer profile 2 keeps its original shape.

The guide channel 3 is also, preferably, individually configured to direct the passage of the hearing aid 200 therethrough, from the lateral entry opening 4 to the medial exit opening 5, such that the hearing aid is let out, by the medial exit opening 5, at a pre-determined insertion depth d in the ear canal. With reference to FIG. 6, the guide channel 3 is configured so that said medial exit opening 5 is adjacent to the pre-determined insertion depth d, preferably remaining in the same position relative to said ear canal 50 during activation of the drive mechanism. The driving mechanism used to move the hearing aid 200 can extend beyond the medial exit opening 5 by a distance Δ, such that the medial exit opening 5 is located at a distance Δ from the pre-determined insertion depth d which may be comprised in a range of 0 to 5 millimeters.

In particular cases, the medial exit opening 5 can be directly located at pre-determined insertion depth d, the distance Δ being 0.

Preferably, the guide channel 3 at the medial exit opening 5 is oriented based on an orientation of the lodging region LR of the ear canal 50 of the individual user. Such lodging region LR is located beyond—or medial of—the medial exit opening 5 and is intended to accommodate the hearing aid 200. By adopting such a configuration of the guide channel 3, it can be advantageously ensured that the hearing aid 200 is pre-arranged to conform to the anatomy of the ear canal 50 at the destination location where it is meant to be eventually placed. Therefore, the hearing aid 200 is moved to the intended lodging region LR, and will sit therein, smoothly and compliantly, in a way that suits the local ear canal anatomy.

Alternatively, for special cases in which the anatomy of the ear canal 50 keeps a rather consistent shape in the bony region 54—for instance, when the orientation does not substantially change between the level where the medial exit opening 5 will be and across the intended lodging region LR—the guide channel 3 at the medial exit opening 5 can be oriented based on an orientation of the ear canal 50 at the pre-determined insertion depth d or at an end plane E of the insertion device 100 where the medial exit opening 5 lies.

Figure 13:
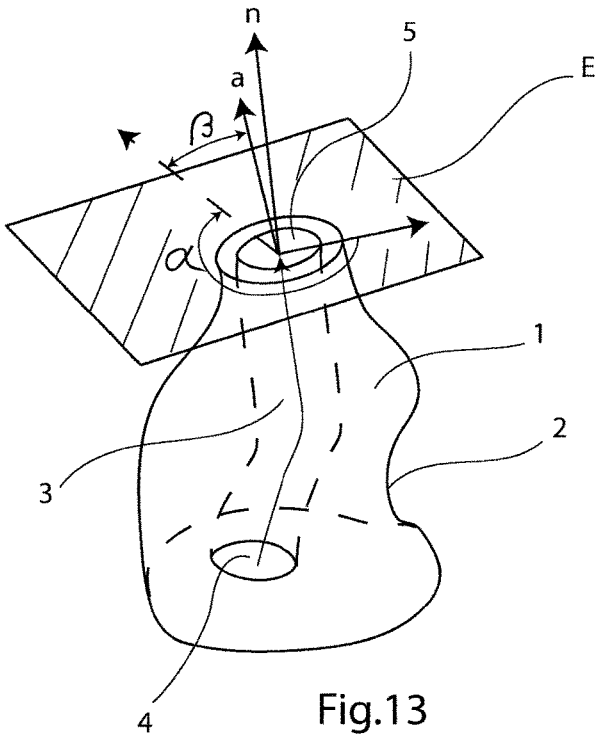
FIG. 13 is a schematic view of a customized support of an insertion device according to the present invention, aimed at introducing an orientation of a guide channel of the customized support, at a medial exit opening of the channel.
Figure 13A:
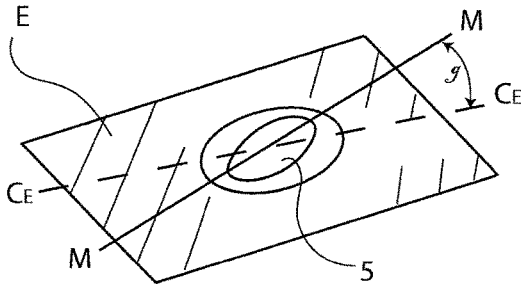
FIG. 13A is a schematic representation of an end plane of the insertion device of FIG. 13, on which the medial exit opening lies, completing the orientation information provided by FIG. 13.
Figure 14:
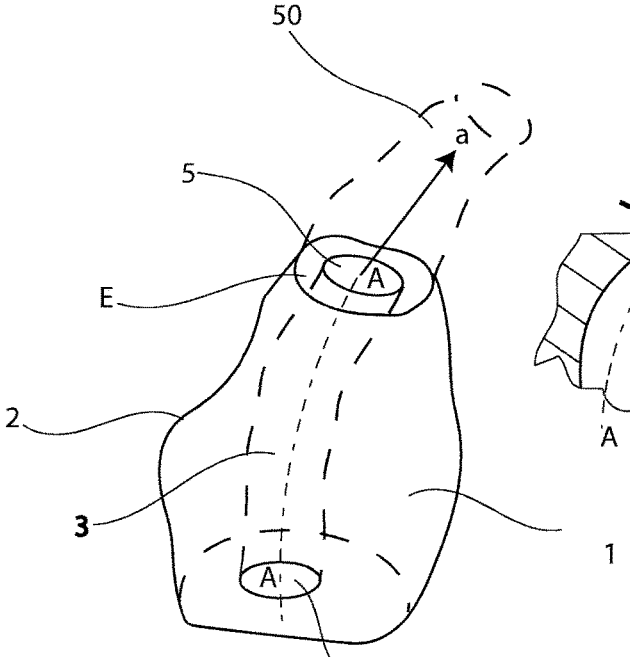
FIG. 14 is a schematic view of a customized support of an insertion device according to the present invention, aimed at portraying a central axis of a guide channel of said customized support.
Figure 14A:
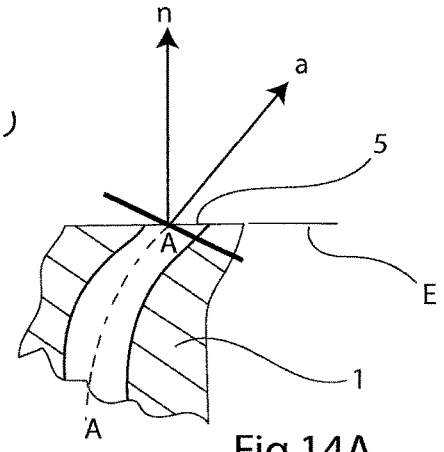
FIG. 14A is a section view of a portion of the customized support represented in FIG. 14, clarifying on the orientation of the central axis of the guide channel, with respect to the orientation of an end plane of the insertion device on which a medial exit opening of the guide channel lies.

With reference to FIGS. 13, 13A, 14 and 14A, it will be in the following exemplified how an orientation of the guide channel 3 at the medial exit opening 5 can be characterized. In FIGS. 13 and 14A, a device end plane E is shown on which the medial exit opening 5 of the guide channel 3 lies. Also represented are a normal to such device end plane E, by way of a vector n; and a central axis A-A of the guide channel 3, directed at the medial exit opening 5 according to a vector a.

Both in FIGS. 13 and 14A the vector n and the vector a, respectively representing the normal to the device end plane E and the central axis A-A of the guide channel 3 at the medial exit opening 5, are at an angle different from zero, that is they are not aligned.

In such a case, the central axis A-A of the guide channel 3 at the medial exit opening 5 defines an elevation angle β, with respect to the device end plane E different from 90° and the projection of the central axis A-A on the device end plane E defines an azimuthal angle α different from zero. As the hearing aid 200 is pushed through the guide channel 3, it will automatically align itself with the axis A-A and will exit along a vector a, according to the medial end of the guide channel 3 (in this case, not according to the medial end of the outer profile 2 of the customized support 1).

In special cases of ear canal geometries, it may be instead verified that the normal n to the device end plane E and the central axis A-A of the guide channel 3 at the medial exit opening 5 are aligned.

With reference to FIG. 13A, a case is assumed wherein the anatomy of the ear canal 50 and the shape of at least a portion of the guide channel 3 are characterized by cross-sections having generally a major axis and a minor axis. Such an assumption is consistent with the fact that the profile of cross-sections of the ear canal 50 can be defined generally elliptic. As a consequence, corresponding cross-sections of the outer profile 2 of the customized support 1 would be generally elliptic to replicate the shape of ear canal 50. At any rate, at least a portion of the guide channel can be designed elliptic or oval or lancet-shaped or generally oblong or elongated in one prevailing direction, in order to at least partly account for such anatomical situation.

An orientation of the medial exit opening 5 of the guide channel 3, with respect to the shape of the cross-section of the customized support 1 lying on the device end plane E, can be therefore complemented with the information of the angle θ comprised between a major axis M-M of the guide channel 3 and a major axis $C_E$-$C_E$ of the customized support 1 (or of the ear canal 50) on such device end plane E.

With reference to FIG. 17, a medial exit opening 5 of guide channel 3 is provided with a substantially elliptical cross section. It can be appreciated how, in this case, the ear canal 50 changes in shape and orientation between the device end plane E and the region LR intended to accommodate the hearing aid 200, because for instance it undergoes further twisting or rotation beyond the end of the insertion device 100. The major axis $C_{LR}$-$C_{LR}$ in the lodging region LR where the hearing aid will (predominantly) sit is rotated relative to the major axis $C_E$-$C_E$ of the ear canal 50 (or of the customized support 1) at the end of the insertion device 100.

The present invention proposes of designing a major axis M-M of the medial exit opening 5, oriented as indicated by a unitary vector m, aligned with the major axis $C_{LR}$-$C_{LR}$ of a first elliptical cross section of the ear canal 50, positioned beyond—or medial of—the device end plane E and in the lodging region LR intended to ultimately accommodate the hearing aid 200. By adopting the above design conditions, it can be guaranteed that, when ejected, the hearing aid 200 will be not only placed at the right insertion depth d, but will be correctly oriented in the ear canal 50, also in terms of rotation angle θ about the normal to the device end plane E.

Even though the individual ear canal 50 in one or more locations is not elliptical in cross-section, it is still important to control the rotation angle θ imparted to the hearing aid 200 at its exit from the insertion tool 100. For instance, if the ear canal 50 is roughly circular or irregularly cylindrical in cross section at the medial exit opening 5 of the insertion device 100, but becomes predominantly elliptical in cross section beyond—or medial of—such opening 5 in the lodging region LR, then it is still critical that locally, i.e. at the end plane E, the major axis M-M of the guide channel 3 line up with the major axis of the ear canal at the lodging region LR. In short, the guide channel 3 at the end plane E shall reflect the orientation of the ear canal 50 where the hearing aid 200 will ultimately be lodged.

In the context of the present invention, it is important, for placement of a hearing aid 200 deep within the ear canal 50 that is both comfortable and free from acoustic feedback, to control the abovementioned degrees of freedom d, α, β, and/or θ during the insertion process. Such control is primarily achieved by the specific design of the guide channel 3 as described. The control can also be further influenced by factors such as insertion speed imparted by the driving mechanism and by insertion techniques such as forward motion periodically interspersed with retrograde motion.

Figure 16:
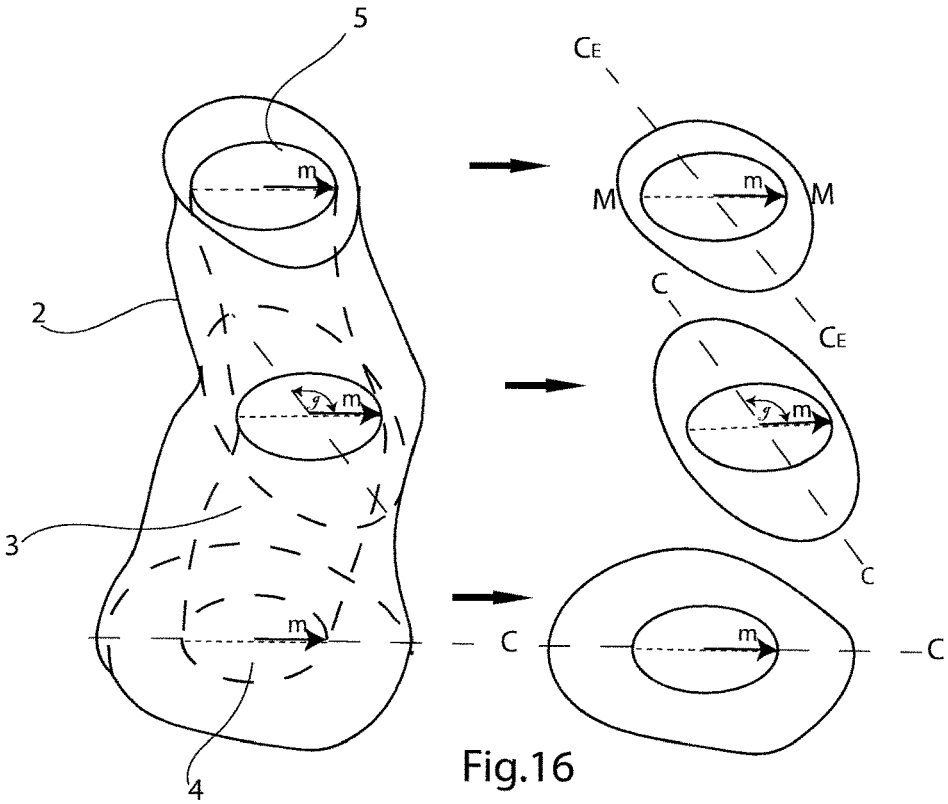
FIG. 16 is a schematic perspective view of a second customized support of an insertion device according to the present invention, showing in transparency an inner guide channel and exemplifying how shape and/or of orientation of cross sections along such guide channel may also be decoupled, to a certain extent, from the anatomy of an ear canal.

With reference to a possible embodiment as represented in FIG. 16, the shape and/or orientation of cross sections of the guide channel 3, from the lateral entry opening 4 to the medial exit opening 5, can remain substantially unvaried, if allowed by overall feasibility constraints given especially by the dimension of the ear canal duct. In FIG. 16, the guide channel's shape and orientation are substantially decoupled from those of the outer profile 2 of the customized support 1 replicating the anatomy of the ear canal 50. The unitary vector m, representing the orientation of a main axis M-M of the guide channel cross-sections, remains unchanged, whereas a main axis C-C of the cross-sections of the customized support 1 (or of the ear canal 50) varies. In this instance, where the guide channel may be "defeatured" relative to the more complex geometry of the ear canal and may not follow the natural twisting thereof, maneuvering of the hearing aid 200 through the guide channel 2 will be made easier, in that lower insertion forces will be required and a risk of damaging the hearing aid 200 will be reduced.

Figure 15:
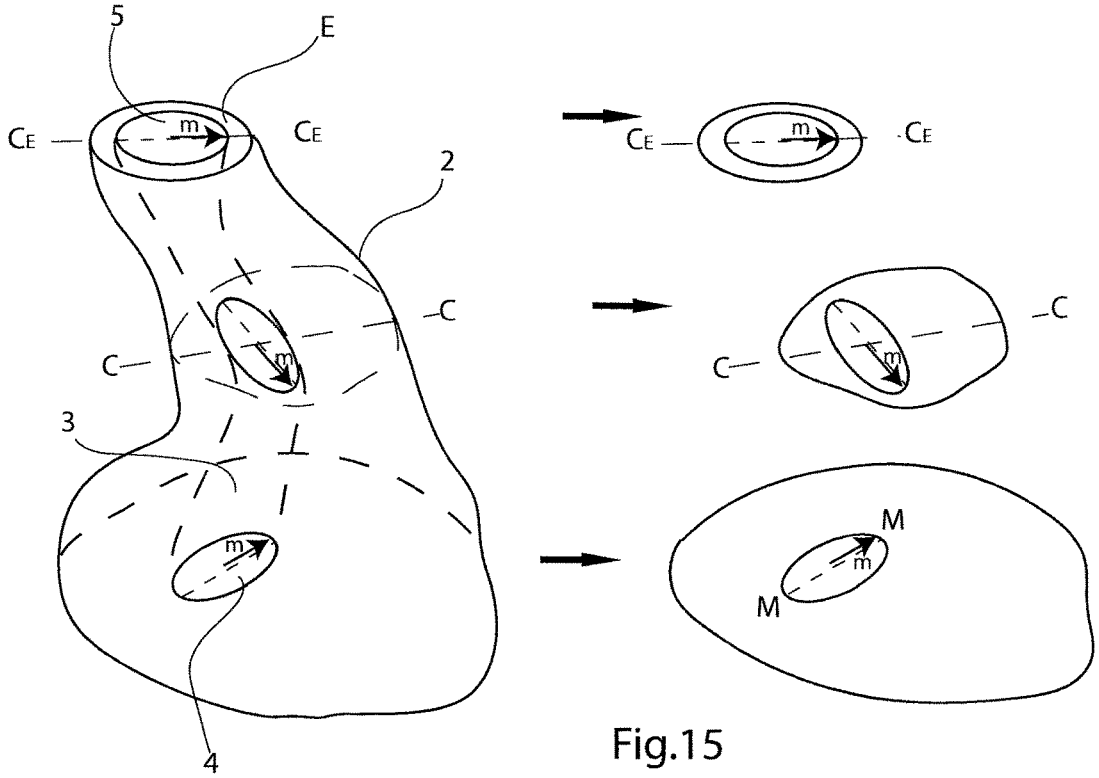
FIG. 15 is a schematic perspective view of a first customized support of an insertion device according to the present invention, showing in transparency an inner guide channel and exemplifying changes of shape and/or of orientation of cross sections along such guide channel, also on account of changes of the anatomy of an ear canal.

With reference, instead, to another possible embodiment as represented in FIG. 15, the shape and/or orientation of cross sections of the guide channel 3, from the lateral entry opening 4 to the medial exit opening 5, may have to vary greatly in order to fit the guide channel 3 entirely within the available space defined by the ear canal 50 and, as a consequence, by the outer profile 2 of the customized support 1. Anyway, this twisting needs to be controlled and enacted gradually along the length of the insertion tool 100, so that advantageously the hearing aid 200 has the time and space to (also rotationally) self-align to the axis A-A of the guide channel 3, as it is driven forward, and does not get jammed or damaged.

On another aspect of the design of the guide channel 3, in FIG. 15 it can be appreciated how, in particular circumstances, a major axis M-M of the guide channel cross-section at the medial exit opening 5 can be aligned with a major axis $C_E$-$C_E$ of a second elliptical cross section of the customized support 1 (or of the ear canal 50) at the device end plane E. This simplified design can be especially advantageous if it is known that the ear canal 50 stays shaped substantially the same between the medial exit opening 5 of the guide channel 3 and the region LR of the ear canal 50 intended to accommodate the hearing aid 200.

With reference to both embodiments of the insertion device 100 according to the present invention, respectively represented in FIGS. 7-9 and 10-12, the drive mechanism comprises at least a rotating drive member 7, 8 to move the hearing aid 200 through the guide channel 3 up to the pre-determined insertion depth d in the ear canal 50.

At least a component 6, 7, 8 of the drive mechanism can be made of a flexible material and/or at least inner walls of the guide channel 3 can be made of compliant material, so that maneuvering the hearing aid 200 through the twists of the ear canal 50—and of the guide channel 3—is made easier and several kinds of movements can be accommodated.

Figure 7:
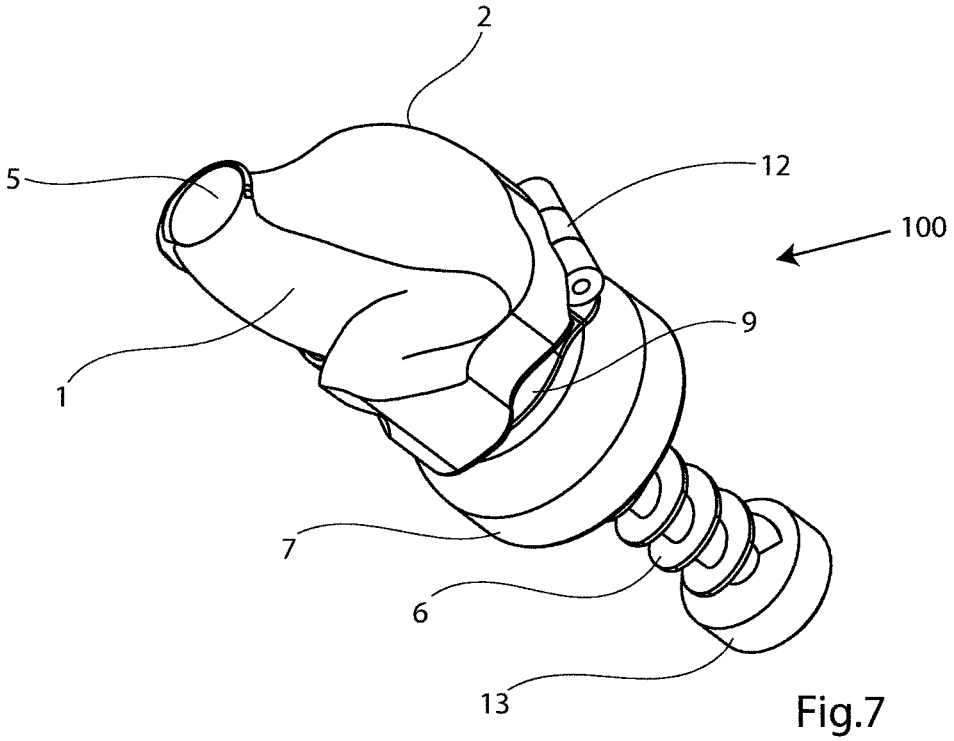
FIG. 7 is a perspective view of a first embodiment of an insertion device according to the present invention.
Figure 8:
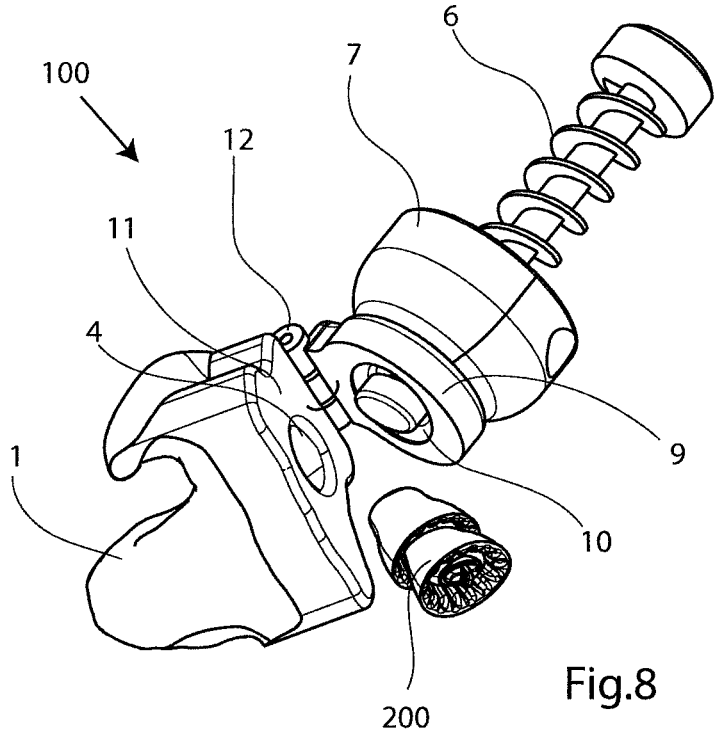
FIG. 8 is a perspective view of the insertion device of FIG. 7, showing a loading configuration wherein a faceplate is moved away from a lateral face of a customized support, in order to allow the loading of a hearing aid by a lateral entry opening.
Figure 9:
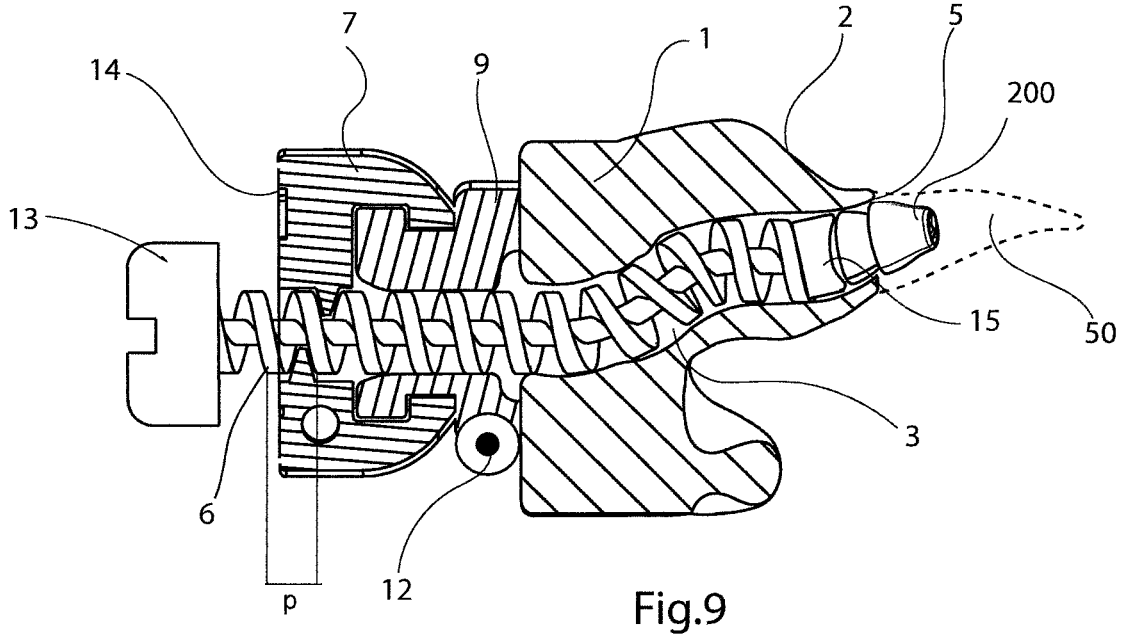
FIG. 9 is a section view of the insertion device of FIG. 8, showing a configuration wherein a drive mechanism has moved a hearing aid through a guide channel of a customized support, from a lateral entry opening up to a medial exit opening thereof, for releasing a hearing aid into an ear canal.

With reference to the first embodiment of the insertion device of FIGS. 7-9, a first drive member 6 is configured to be advanceable through the guide channel 3. A second, rotating, drive member 7 engages the first rotating member 6 in a way that a rotation of the second drive member 7 produces a corresponding displacement of the first drive member 6, through said lateral entry opening 4, along said guide channel 3.

In the particular case portrayed in the above Figures, the first drive member 6 advances with a linear movement.

Preferably, the first drive member is a screw rod 6 and the second rotating driving member is a knob or wheel 7 threadedly engaging the screw rod 6.

The screw rod 6 is formed with at least a helical thread, preferably with two threads. The use of two, or more, adjacent but independent threads, for instance helical threads, has the advantage of offering a relatively large contact area between screw rod 6 and knob 7, while preserving the flexibility properties of the screw rod 6 and also allowing a fast insertion with a relatively low number of knob revolutions.

In fact, a substantial contact area between drive mechanism components is important to guarantee that a high torque moment applied to the knob 7 by a user does not result in excessive stresses damaging the screw rod thread.

A thread pitch p of the screw rod 6 comprised in a range of 3-5 millimeters, preferably combined with a double helix, may be optimal in balancing the need of enough flexibility and robustness of the mechanism and the desire to keep the revolutions for carrying out insertion of the hearing aid to a relatively low number.

By way of example, a thread angle of around 4° and a thread thickness comprised in a range of 0.5-1 mm may prove advantageous for bendability and compliance in the guide channel 3, on one hand, and robustness, on the other hand.

It is possible according to the present invention, though not an absolute requirement, to differentiate a device 100 intended for hearing aid insertion in a right ear from a device 100 intended for hearing aid insertion in a left ear, in that the former can be provided with right-handed threads, whereas the latter can be provided with left-handed threads. By doing so, an operator or a user will be able to manipulate the insertion device 100 intuitively, always turning the knob 7 forward or clockwise for either ear, by applying a rotation oriented towards the user's own nose. The insertion technique will thus be easier to remember and master than in the case where the insertion device according to the present invention needs to be turned forward or clockwise for insertion on one side, but backward or anti-clockwise for insertion on the opposite side.

Preferably, the screw rod 6 and/or the knob or wheel 7 and/or the inner walls of the guide channel 3 are made of, or coated with, lubricious material, such as Teflon, for improved slidability of the drive mechanism relative to the guide channel 3. It may also be possible to actively lubricate screw 6 and/or knob 7 and/or inner walls of the guide channel 3.

Preferably, the screw rod 6 has an elliptical cross section to key to the elliptical cross section of said guide channel 3. Thus, the screw rod 6 is prevented from spinning in place as the knob 7 is turned and from not progressing either forwards or backwards.

As shown in FIG. 9, the insertion device according to the present invention can comprise a faceplate 9 that is coupled:

- at a lateral end thereof, with the second, rotating driving member 7; and
- at a medial end thereof, with the customized support 1.

The arrangement is such that free rotative movement of the second drive member 7 is allowed relative to the faceplate 9. The faceplate 9 comprises a through bore 10 configured so that the first drive member 6, displaced by the second, rotating drive member 7, enters the guide channel 3 through the lateral entry opening 4, thus moving the formerly loaded hearing aid 200, through the guide channel 3, to the pre-determined insertion depth d.

The faceplate 9 and the customized support 1 comprise a loading mechanism, arranged such that, in an insertion configuration such as the one shown in FIG. 9, the faceplate 9 abuts against a lateral face 11 of the customized support 1 and the through bore 10 is substantially aligned with the lateral entry opening 4 of the guide channel 3. This allows the passage of the first drive member 6 through the second drive member 7 and the faceplate 9 and its displacement, by the lateral entry opening 4, along the guide channel 3.

In a loading configuration, such as the one shown in FIG. 8, the faceplate 9 is moved away from the lateral face of the customized support 1, to allow the loading of a hearing aid 200 in the lateral entry opening 4.

The loading mechanism may comprise a hinge 12 by which the faceplate 9 is rotatively engaged with the customized support 1.

The first drive member 6 preferably comprises a stop element 13 configured to abut against a lateral stop surface 14 of the second drive member 7, so as to define the maximum advancement possible of said first drive member 6 in the guide channel 3.

The length of the first drive member 6 is such that, when totally inserted, a medial end thereof protrudes out of, or is substantially flush with, the medial exit opening 5, so as to bring the hearing aid 200 to the pre-determined insertion depth d in the ear canal 50.

In a further embodiment of the present invention (not shown), the drive mechanism above described could be modified in the sense of eliminating the interface of the knob 7 and modifying the faceplate 9 to threadedly engage the screw rod 6. The faceplate would incorporate a female thread engaging means, matching with the screw rod's thread. In this case, the screw rod 6 would be directly rotated by the operator or user, advancing in this case with both a linear and a rotational movement through the guide channel 3.

Figure 10:
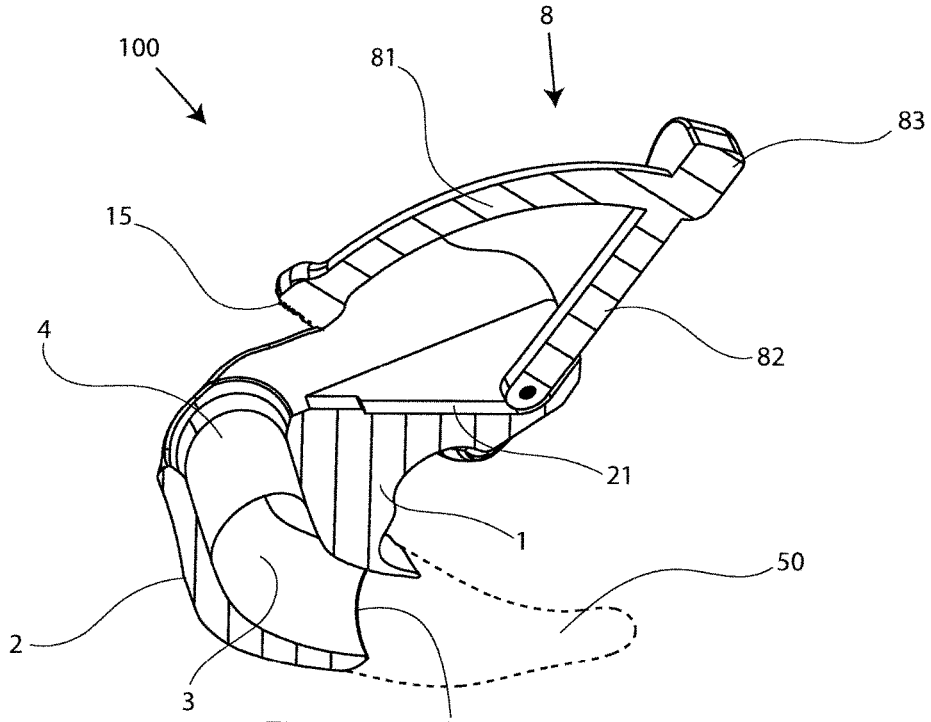
FIG. 10 is a section view of a second embodiment of an insertion device according to the present invention.
Figure 11:
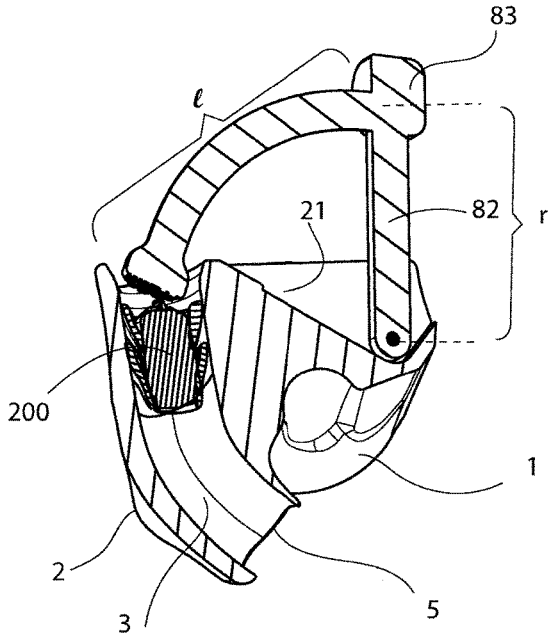
FIG. 11 shows the insertion device of FIG. 10, more specifically portraying a configuration wherein a hearing device is positioned in proximity of a lateral entry opening of a guide channel of the insertion device.
Figure 12:
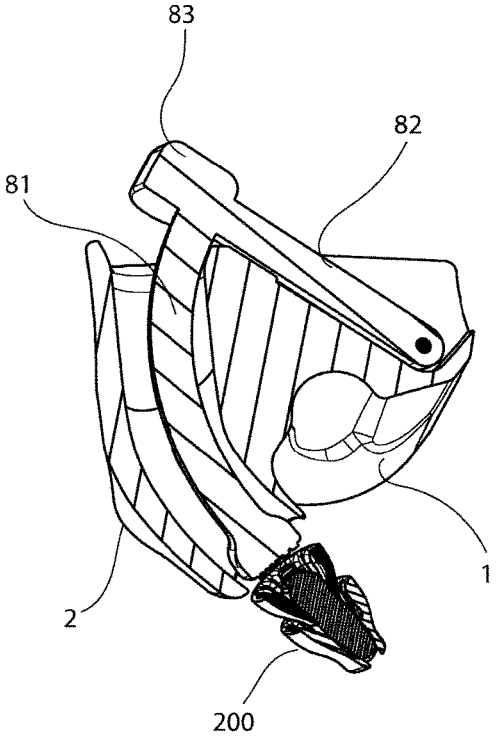
FIG. 12 shows the insertion device of FIG. 10, more specifically portraying a configuration wherein a hearing device has been moved by a drive mechanism of the insertion device past a medial exit opening of a guide channel, for releasing of the hearing aid into an ear canal.

With reference to FIGS. 10-12, the drive mechanism comprises a lever push rod 8. In this case, the guide channel can be substantially a planar arc (i.e. substantially, a circular arc confined to a plane) and the lever push rod 8 can be curve-shaped and configured to fit in such guide channel 3. The lever push rod 8 may have a small amount of play and adjustability. For a guide channel 3 which is not a perfect planar arc, a flexible level push rod 8 may be used to enhance compatibility with the guide channel geometry.

In the specific example of FIGS. 10-12, the rotating drive member in the form of a level push rod 8 is hinged to the customized support 1. The lever push rod 8 is configured to move the hearing aid 200 through the guide channel 3 from the lateral entry opening 4 up to said pre-determined insertion depth d in the ear canal 50.

Preferably, the length 1 and/or the radius r of the lever push rod 8 is a function of the anatomy of the ear canal 50 of the individual user.

An insertion device 100 according to the present invention as represented in FIG. 10 preferably comprises a stop surface 21, for instance on the customized support 1, configured to define a maximum rotation limit for the lever push rod 8. When the lever push rod 8 abuts against the stop surface 21, the medial end of the lever push rod 8 protrudes out of, or is substantially flush with, the medial exit opening 5, having moved the hearing aid 200 through the guide channel 3 up to the pre-determined insertion depth d in the ear canal 50.

Preferably, at least a drive member 6,8 of the drive mechanism comprises a medial pad element 15 adapted to contact the hearing aid 200 when moving through the guide channel 3. Such a medial pad element 15 can comprise a concave recess adapted to receive the hearing aid 200 and may be therein cushioned so as to not damage in any way the lateral end of the hearing aid 200 and for protection of the ear canal walls. The medial pad element 15 may also comprise frictional surface patterns or features, so as to have a better grip on the hearing aid 200. The medial pad element 15 may be attached to said drive member 6, 8 by a rotatable joint, such as a ball and socket joint, so that the movement of the hearing aid 200 along the guide channel 3 can benefit from more degrees of freedom and rotational adjustments are made easier.

Moreover, the drive mechanism—for instance, drive members 7 or 8- and/or the medial pad element 15 can also comprise a damping feature for applying a damping coefficient, such as a dashpot or similar, so that the insertion happens even more smoothly and brisk operator or user movements are even further decoupled from the advancement imparted to the hearing aid 200.

With reference to FIG. 20, an insertion device 100 according to the present invention can comprise a magnetically actuatable control means and/or an optical control means and/or a radio control means, configured to adjust the operational parameters of a signal processing circuitry of the hearing aid 200. The magnetically actuatable control means 17 can take the form, for instance, of a GMR-switch, a TMR-switch, an AMR-switch, a reed switch, a magnetic coil or a Hall effect sensor. Also by way of example, the optical control means can take the form of a light beam source and the radio frequency control means can take the form of a Bluetooth control. Such controls means are configured to remotely cooperate with the signal processing circuitry of the hearing aid 200, respectively by applying magnetic fields; or by emitting radio signals; or by expressly emitting some specific kind of light beams. Thanks to this solution, when the insertion tool 100 is in place, programming; setting changes and/or diagnostics of the extended wear hearing aid 200 can be accomplished. Possibly with the aid of a mobile platform cooperating with the insertion device 100 (such as, for instance, a smartphone connected to the insertion device controls and provided with dedicated applications), relevant data can be communicated to a customer service or to logistics services of the hearing aid producer; or a hearing device replenishment process can be triggered; or real-time remote assistance, for instance by a connected healthcare professional, can be provided.

An insertion device 100 according to the present invention can also comprise an electroacoustic detection means and/or a visual detection means (in either case referenced in the drawings by number 18) for detecting and verifying the functionality of the hearing aid 200 and/or for enabling an evaluation of an individual user of such hearing aid 200. The electroacoustic detection means can, for instance, take the form of a microphone and/or a receiver. The evaluation of the individual user can therefore be an audiological evaluation. A camera can be employed as the visual detection means. Therefore, an audio and/or visual alert system is enabled, for instance to signal unsuccessful hearing aid insertion; or lack of proper acoustic output in the hearing aid; or detection of critical feedback levels. Follow-up actions can be instructed from remote, as a result of the above alerts, according to a pre-programmed workflow, for instance by way of re-programming, adjusting gain levels or instructing to insert an extended wear hearing aid anew or replace it.

An insertion device 100 according to the present invention may comprise humidity sensor means 19 for measuring the humidity in an ear canal 50 and/or optical measurement means for detecting the physical state of said ear canal 50. Thus, ear health data can be collected to monitor the level of humidity in an ear canal 50. Moisture accumulation was in fact found to lead to early hearing aid failures. A connected mobile platform as above introduced, cooperating with the insertion device 100 according to the present invention, can be provided with an algorithm to determine a current status of ear health. The related information can then be forwarded to a health care professional or to a customer service of the hearing aid manufacturer. In critical cases, based on the indications coming from the insertion device 100, it can be recommended that a patient seek medical evaluation, therefore reducing the risk of injury in case of hearing aid self-insertion.

An insertion device 100 according to the present invention may also be provided with presence and/or proximity sensor means 20 and/or visual detection means 20 for detecting the presence of a foreign object 500 or of a pre-existent hearing device in the ear canal 50. Preferably, such presence and/or proximity sensor means and/or visual detection means cooperates with locking means 16 for locking the drive mechanism 6, 7 moving said hearing aid 200 through the guide channel 3. Such presence and/or proximity sensor means 20 may also comprise or cooperate with alert means to signal the presence of a foreign object 500 or of a pre-existent hearing device, for instance to the individual user or to an operator, by producing audio alert signals and/or visual alert signals.

The insertion device 100 according to the present invention can be advantageously used for achieving an accurate, effective and customized placement into an ear canal also of other devices, different from an extended wear hearing aid 200.

By way of example, the insertion device 100 can be employed for guiding the placement of a multi-functional communication unit into an ear canal 50, at a pre-determined insertion depth d thereof, by an operator distinct from an individual user receiving the multi-function communication unit, or directly by the individual user.

Said communication unit can be configured to detect and transfer to further entities, located external to the ear canal 50, information relating to the ear canal itself and/or relating to a hearing aid 200 already in place deep in such ear canal 50. For instance, the multi-function communication unit could cooperate with a mobile platform, similarly to what above introduced in connection with data collection by the insertion device 100. By providing said multi-functional communication unit with control means and sensing means as described in combination with the insertion device 100, data relating to the state of an ear canal and/or relating to a hearing aid 200 can be forwarded to a customer service or to a health care professional, also after completion of the insertion of a hearing aid 200 by an insertion device 100. Troubleshooting of detected critical situations or evaluation of patient's health and hearing is thereby enabled. A multi-functional communication unit can be left in the ear canal 50 for the time required to collect and transmit the necessary data, and subsequently retracted by using the same insertion device 100 used for the placement thereof.

The present invention also relates to a method of manufacturing an insertion device 100 for inserting a hearing aid 200 deep into an ear canal 50, at a pre-determined insertion depth d thereof. As pointed out, an insertion device operator can be directly the individual user of the hearing aid, self-manipulating the insertion device in an own ear canal; or a distinct operator assisting the individual hearing aid user.

Such method comprises the steps of obtaining data representative of shape and orientation of at least a portion of a conchal cavity 60 and of an ear canal 50 of a hearing aid user. The concept of orientation in an insertion device 100, in relation to an ear canal 50, has been introduced above when describing FIGS. 13-17, making use of angles α, β, and θ.

The method comprises further the steps of providing, based on said shape and orientation data, a customized support 1 as above described, comprising:

- an outer profile 2 individually shaped to replicate the shapes of at least a portion of the conchal cavity 60 and of the ear canal 50 of an individual user of the hearing aid 200; and
- a guide channel 3, disposed internal to the outer profile 2, extending between a lateral entry opening 4 thereof, for loading the hearing aid 200; and a medial exit opening 5 thereof, for releasing the hearing aid 200 into the ear canal 50; and
- a drive mechanism 6, 7, 8, actuatable by an insertion device operator, for moving the hearing aid 200 through the guide channel 3 from the lateral entry opening 4 up to the pre-determined insertion depth d.

The drive mechanism is preferably provided with at least one rotating drive member (such as knob 7 or lever push rod 8) configured such that, during activation of the drive mechanism through rotation of the rotating driving member, an advancement of the hearing aid 200 through the guide channel 3 is at least partially decoupled from the force applied by the insertion device operator on such at least one rotating drive member 7; 8.

The guide channel 3 is designed by taking into account the orientation α, β, θ of a lodging region LR of the ear canal 50 of said individual user, beyond the medial exit opening 5, intended to accommodate the hearing aid 200. In particular cases—especially when the ear canal 50 substantially keeps one same conformation over a longer trait—the orientation α, β, θ of the ear canal 50 at the pre-determined insertion depth d and/or at the insertion device end plane E can be taken into account for designing the guide channel 3.

The method according to the present invention can comprise the step of providing the guide channel 3 with a substantially elliptical cross section, at least at said medial exit opening 5, and the step of aligning a major axis M-M of said substantially elliptical cross section with a major axis $C_{LR}$-$C_{LR}$ of a first elliptical cross section of the lodging region LR of the ear canal 50.

Alternatively—especially for cases of an ear canal 50 that remains unchanged over a longer portion of its longitudinal axis—the major axis M-M of such substantially elliptical cross section can be aligned with a major axis C-C of a second elliptical cross section of the ear canal 50, for instance at said pre-determined insertion depth d and/or at the insertion device end plane E (in this latter case, for example, the distance Δ shown in FIG. 6 comes to be zero).

Furthermore, the method according to the present invention may comprise the step of determining the orientation of the lodging region LR based on the orientation of a multiplicity of cross sections of the ear canal 50. This may be achieved, for instance, by making an average of the orientation of intermediate cross-sections of the ear canal 50 disposed across the lodging region LR where the hearing aid 200 is intended to be accommodated. Such a multiplicity of cross sections may be chosen among orthogonal cross-section which are perpendicular to the longitudinal axis of the ear canal 50. The average above defined can be a weighted average of the orientation of intermediate cross-sections of the ear canal 50.

Providing a guide channel 3 internal to the customized support 1 as above described preferably comprises the step of taking into account the constraint of the outside profile 2 of the customized support 1.

The shape and orientation data of at least a portion of a conchal cavity 60 and of the ear canal 50 are preferably derived by:

- digital intra-aural scanning said at least a portion of a conchal cavity 60 and of an ear canal 50 of said individual user; or
- taking an impression of said at least a portion of the conchal cavity 60 and of the ear canal 50; and/or
- scanning an impression of said at least a portion of the conchal cavity 60 and of the ear canal 50.

The information necessary in order to design the outer profile 2 and the guide channel 3 of the customized support 1 can be collected by scanning an impression 400 as shown in FIG. 19, preferably capturing not only the anatomy of the ear canal 50 but also at least a portion of an individual user's concha 60 and incorporating respective anatomy landmarks as usable scan references.

The impression 400 comprises a cured impression-taking material and an impression-taking pad 300 fixedly engaged with the cured impression-taking material. The contour of the impression substantially provides the information relative to the outer profile 2 of the customized support 1 of the present insertion device 100.

The impression 400 is obtained by inserting the impression-taking pad 300 in the ear canal 50 by some currently available tool in a way that a medial end of the impression-taking pad 300 is arranged in the ear canal 50 proximate to a tympanic membrane 56. Subsequently, the ear canal 50 and at least part of the concha 60 is filled with impression-taking material, for instance a silicone based material, up to the impression-taking pad 300, which remains embedded into the impression-taking material. The impression-taking material is let cure within the ear canal 50 to become integral with the impression-taking pad 300 and to consequently form the impression 400.

In FIGS. 18 and 18A, a correlated procedure of taking an impression of an ear canal 50 and of a concha 60 employing an impression-taking material and an impression-taking pad 300 is exemplified. The impression taking pad 300 is also known as oto-dam and can take the form of a foam plug. A model of impression-taking pad 300 as shown in FIGS. 18 and 18A exhibits increased bonding characteristics with an impression-taking material or compound, thanks to its scalloped, porous inner surface presenting an increased contact area; as well as improved properties of retaining a deformed shape taken up when positioned at an intended location of an ear canal, so that the impression-pad 300 efficiently forms an integral part of the final scannable impression 400. A pressure relief means 301 can carry out the additional function of a pad removal means.

FIG. 18A shows how the hollow contour of the outer body of the impression-pad 300 can be provided with an elliptic cross section, in order to increase the conformity with the ear canal wall 50, to provide a fluid-tight contact with such walls.

The scanning of the impression 400 results in precise ear canal impression model data, complete with the information conveyed by the impression pad 300. Such data can be further refined or processed by some CAD design software.

Consequently, the customized support 1 can be manufactured—preferably by means of a subtractive (e.g. milling) and/or additive (e.g. rapid prototyping) production step(s)—using such ear canal impression model data. This allows to obtain a high quality customized support 1 of an insertion device 100 according to the present invention. Post-processing may be desired, for instance in order to eliminate undercuts from the outer profile 2 and improve the ability of the insertion device 100 to slide in the ear canal 50, by expressly creating additional margins of tolerance in selected areas.

In order to further improve the precision of the design of the customized support 1 of the insertion device 100 according to the present invention, a sizer replicating the geometry of the hearing aid 200 can be used as impression-pad 300 in the above described impression-taking procedure. The word "sizer", in the present context, designates a device having substantially the same medial and lateral seal retainers (or "seals") 204 and 206 as the hearing aid 200 to be inserted; and a non-operative core dimensionally equivalent to the core of such hearing device 200. For this purpose, also a two-part sizer can be used as described in PCT/US2016/021845, which is hereby incorporated by reference. In this latter case, a lateral portion of the sizer (equivalent to the lateral seal retainer 206) can be removed, once the complete sizer has been introduced in the ear canal at a pre-determined location substantially corresponding to the pre-determined insertion depth d. The medial portion of the sizer (equivalent to the medial seal retainer 204) is left behind in the ear canal 50. Impression material will be then injected in the ear canal and will cure, binding with the medial portion of the two-part sizer.

Thus, scanning of an ear mold impression 400 retaining such a sizer in-situ will provide not only reliable information on the configuration of the deep ear canal, but also information on the actual placement of the hearing aid 200 relative to the ear canal 50 which is extremely consistent with the intended scenario.

In order to manufacture the insertion device 100 according to the present invention, it may also be envisaged a simplified procedure to be carried out totally in-situ. In this instance, a dummy insertion device already incorporating a preliminary guide channel may be provided, to be further customized in situ during impression taking operations. After inserting the guide channel in the bony region of the ear canal 50, impression taking material is employed to fill the ear canal and at least part of the concha and to therein cure. As a result of curing, the actual anatomical situation is "frozen" in situ and a possible configuration of the customized support 1 and of the guide channel 3 is directly obtained. In this simplified case, no scanning of the impression 400 is needed, as the impression-taking procedure itself, in cooperation with a dummy insertion device, produces a customized insertion device, to be possibly further complimented with a drive mechanism and/or other components.

Conversely, once the insertion device 100 according to the present invention has been manufactured, it can be advantageously used also to guide and assist with a precision placement, in an individual ear canal 50, of oto-dams or sizers, alleviating the difficulty that hearing aid fitters encounter when performing these tasks.

The invention claimed is:

1. A device for insertion of a deep-in-the-canal hearing aid into an ear canal of an individual user at a pre-determined insertion depth thereof, comprising:

a customized support comprising an outer profile conforming to shapes of at least a portion of a conchal cavity and of an ear canal of said individual user;

a guide channel, disposed internal to said outer profile, extending between a lateral entry opening thereof, for loading said hearing aid; and a medial exit opening thereof, for releasing said hearing aid into said ear canal;

a drive mechanism for moving said hearing aid through said guide channel from said lateral entry opening up to said pre-determined insertion depth;

wherein said outer profile is individually shaped to replicate shapes of said at least a portion of a conchal cavity and of an ear canal of said individual user and is resistant to deformation.

2. The device of claim 1, wherein said guide channel is configured so that said medial exit opening is adjacent to, or located at, said pre-determined insertion depth of said ear canal and remains in the same position relative to said ear canal during activation of said drive mechanism.

3. The device of claim 2, wherein said medial exit opening is located at a distance from said pre-determined insertion depth comprised in a range of 0 to 5 millimeters.

4. The device of claim 1, wherein said guide channel at said medial exit opening is oriented based on an orientation of a lodging region (LR) of the ear canal of said individual user, beyond said medial exit opening, intended to accommodate said hearing aid; or oriented based on an orientation of said ear canal at said pre-determined insertion depth.

5. The device of claim 1, comprising a device end plane on which said medial exit opening of said guide channel lies, wherein a normal to said device end plane and a central axis of said guide channel at said medial exit opening are at an angle different from zero.

6. The device of claim 1, comprising a device end plane on which said medial exit opening of said guide channel lies, wherein a normal to said device end plane and a central axis of said guide channel at said medial exit opening are aligned.

7. The device of one of claim 1, wherein the shape and/or orientation of cross sections of said guide channel from said lateral entry opening to said medial exit opening remains substantially unvaried.

8. The device of claim 1, wherein at said medial exit opening a substantially elliptical cross section of said guide channel is provided and a major axis thereof is aligned with a major axis of an elliptical cross section of said ear canal positioned beyond a device end plane in a lodging region intended to accommodate said hearing aid.

9. The device of claim 1, wherein said drive mechanism comprises at least a rotating drive member to move said hearing aid through said guide channel up to said pre-determined insertion depth in the ear canal.

10. The device of claim 9, wherein at least a drive member of said drive mechanism is made of a flexible material and/or at least inner walls of said guide channel are made of compliant material.

11. The device of claim 10, comprising a faceplate coupled:

at a lateral end thereof, with said second rotating driving member, free rotative movement of said second drive member being allowed relative to said faceplate; and at a medial end thereof, with said customized support, wherein said faceplate comprises a through bore configured so that said first drive member, displaced by said second drive member, enters said guide channel through said lateral entry opening.

12. The device of claim 11, wherein said faceplate and said customized support comprise a loading mechanism, so that in an insertion configuration, the faceplate abuts against a lateral face of said customized support and said through bore is substantially aligned with said lateral entry opening;

in a loading configuration, the faceplate is moved away from said lateral face of said customized support to allow the loading of a hearing aid in said lateral entry opening.

13. The device of claim 1, comprising a magnetically actuatable control means and/or an optical control means and/or a radio frequency control means configured to adjust the operational parameters of a signal processing circuitry of said hearing aid.

14. The device of claim 1, comprising an electroacoustic detection means and/or a visual detection means for detecting and verifying the functionality of said hearing aid and/or for enabling an audiological evaluation of said individual user.

15. Method of manufacturing an insertion device for inserting a hearing aid deep into an ear canal of an individual hearing aid user, at a pre-determined insertion depth thereof, comprising the steps of:

obtaining data representative of shape and orientation of at least a portion of a conchal cavity and of said ear canal of said individual user;

based on said shape and orientation data, providing a customized support comprising:

an outer profile individually shaped to replicate shapes of at least a portion of a conchal cavity and of said ear canal of said individual user; and a guide channel, disposed internal to said outer profile, extending between a lateral entry opening thereof, for loading said hearing aid; and a medial exit opening thereof, for releasing said hearing aid into said ear canal;

a drive mechanism for moving said hearing aid through said guide channel from said lateral entry opening (4) up to said pre-determined insertion depth;

wherein said guide channel is designed by taking into account the orientation of a lodging region of the ear canal of said individual user, beyond said medial exit opening, intended to accommodate said hearing aid; and/or the orientation of said ear canal at said pre-determined insertion depth.

16. The method of claim 15, comprising the step of providing said guide channel with a substantially elliptical cross section, at least at said medial exit opening, and the step of aligning a major axis of said substantially elliptical cross section:

with a major axis of a first elliptical cross section of said lodging region of said ear canal; or with a major axis of a second elliptical cross section of said ear canal at said pre-determined insertion depth and/or at an end plane of the insertion device.

17. The method of claim 15, comprising the step of determining the orientation of said lodging region based on the orientation of a multiplicity of cross sections of said ear canal disposed across said lodging region where said hearing aid is intended to be accommodated.

18. The method of one of claim 15, wherein providing said guide channel comprises the step of taking into account the constraint of said outside profile of said customized support.

19. The method of claim 15, wherein shape and orientation data of at least a portion of a conchal cavity and of said ear canal are derived by:

digital intra-aural scanning said at least a portion of a conchal cavity and of an ear canal of said individual user; or taking an impression of said at least a portion of a conchal cavity and of said ear canal; and/or scanning an impression of said at least a portion of a conchal cavity and of said ear canal.

20. The method of claim 15, wherein said drive mechanism is provided with at least one rotating drive member configured such that, during activation of said drive mechanism through rotation of said rotating drive member by an insertion device operator, an advancement of said hearing aid through said guide channel, from said lateral entry opening up to said pre-determined insertion depth, is at least partially decoupled from the force applied by said device operator on said at least one rotating drive member.

* * * * *